US006805254B2

(12) United States Patent
Tänzer et al.

(10) Patent No.: US 6,805,254 B2
(45) Date of Patent: Oct. 19, 2004

(54) COLLAPSIBLE CONTAINER

(75) Inventors: Reinhard Tänzer, Wolfsburg (DE); Arnd Serbin, Leiferde (DE); Georg Bill Wyzisk, Salzgitter (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 10/227,916

(22) Filed: Aug. 26, 2002

(65) Prior Publication Data

US 2003/0071038 A1 Apr. 17, 2003

Related U.S. Application Data

(63) Continuation of application No. PCT/EP01/01933, filed on Feb. 21, 2001.

(30) Foreign Application Priority Data

Feb. 26, 2000 (DE) ..... 100 09 272

(51) Int. Cl.[7] ..... B65D 6/22
(52) U.S. Cl. ..... 220/6; 220/4.29
(58) Field of Search ..... 220/6, 4.28, 4.29, 220/617, 7, 636, 531, 635, 626, 627; 206/600, 386; 217/43 A

(56) References Cited

U.S. PATENT DOCUMENTS 3,875,871 A * 4/1975 Thornton et al. ..... 105/375
5,829,595 A * 11/1998 Brown et al. ..... 206/600
5,833,114 A * 11/1998 Linnell ..... 220/531

FOREIGN PATENT DOCUMENTS

| | | | |
|---|---|---|---|
| DE | 94 13 518.5 | U1 | 11/1994 |
| DE | 295 03 254.5 | U1 | 6/1995 |
| FR | 2578224 | A1 * | 9/1986 |
| FR | 2 663 004 | A1 | 12/1991 |

* cited by examiner

*Primary Examiner*—Stephen Castellano

(57) ABSTRACT

A collapsible container has a bottom formed of a plastic preform with grooves along the peripheral edge wall of the plastic preform. The side walls of the container are inserted into the grooves. A supporting base is fastened as a folding part or as folding parts to one or more side walls. The number of parts to be manipulated is reduced by the fact that the supporting base is no longer provided as a separate part. The labor associated with the supporting base is limited to folding the folding part or parts against the side wall or walls when collapsing the container, and is limited to folding out the folding part or parts when assembling the container. In addition, the container is stabilized when filled. The items placed therein press against the folding part or parts such that the side walls are pressed into the grooves.

15 Claims, 2 Drawing Sheets

COLLAPSIBLE CONTAINER

CROSS-REFERENCE TO RELATED APPLICATION

This application is a continuation of copending International Application No. PCT/EP01/01933, filed Feb. 21, 2001, which designated the United States and was not published in English.

BACKGROUND OF THE INVENTION

Field of the Invention

The invention relates to a collapsible container having a plastic preform as a bottom. The bottom has downwardly molded-out hollows as feet, between which there is space for the engagement of a lifting fork of a forklift truck. On the edge wall of the bottom, grooves extend in each case from one hollow and to next hollow. The side walls of the collapsible container are connected to one another such that they can be folded at the vertical container edges. The side walls are to be inserted into the grooves and, if appropriate with downwardly projecting portions thereof, into the hollows and are supported in the grooves and if appropriate the hollows. The collapsible container further includes a support bottom.

Such a container, without a support bottom, is disclosed in German Utility Model No. DE-U 94 13 518. When this conventional container is used, it generally includes a support bottom, and also a lid.

In the collapsed state of the container, the side walls are removed from the grooves and hollows of the bottom and folded up so that they are flat. The smaller side walls can be bent in at a folding line provided along their center, so that, in the folded-up flat state, only the dimensions of the larger side walls remain.

The parts can then be put together to form a flat pack of the size of the bottom surface of the container. Where a relatively large number of emptied containers is to be returned, it is also possible to leave a container in its "use state" and fill this container with the folded-up side walls and support bottoms of other containers, the bottoms and lids of which are in each case stacked.

SUMMARY OF THE INVENTION

It is accordingly an object of the invention to provide a collapsible container which can be handled in a simple manner.

With the foregoing and other objects in view there is provided, in accordance with the invention, a collapsible container, including:

a plastic preform as a container bottom;

the plastic preform having downwardly molded-out hollows formed therein as feet for the container bottom, the feet being spaced apart from one another and defining a lifting fork engagement space therebetween;

the plastic preform having an edge wall, the plastic preform being formed with grooves extending along the edge wall, the grooves starting at a respective one of the hollows and ending at a respective next one of the hollows;

side walls configured to be inserted into the grooves and configured to be supported in the grooves, the side walls, when inserted in the grooves, defining vertical container edges, the side walls being connected to one another at the vertical container edges and being foldable at the vertical container edges, the grooves being configured to support the sidewalls when inserted in the grooves; and a support bottom including a support bottom part fastened as a folding part to one of the side walls.

In other words, according to the invention, there is provided, a collapsible container having a bottom formed of a plastic preform, which has downwardly molded-out hollows as feet, between which there is space for the engagement of a lifting fork of a forklift truck, and on the edge wall of which, in each case starting from one hollow and ending in the next hollow, grooves run, and having side walls which are connected at the vertical container edges so as to be foldable together and which are to be inserted into the grooves and, if appropriate with downwardly projecting portions, into the hollows and are to be supported in the grooves and if appropriate the hollows, and also having a support bottom, wherein the support bottom in the form of a folding part or a plurality of folding parts is fastened to one or, respectively, a plurality of the side walls.

The number of parts, more specifically the number of separable parts, is thus reduced by one part. The work associated with the support bottom is limited to folding the folding part or the folding parts onto the side wall or, respectively, the side walls when the container is collapsed and folding out the folding part when the container is assembled.

At the same time, the container is stabilized considerably in the filled state. The material filling the container presses, with its weight bearing down on the folding part or parts, the four side walls downward into the grooves and the hollows of the bottom. Even if the container is to be pushed by lateral force application onto a side wall, the side walls do not tip out of the grooves and the hollows of the bottom on one side.

According to a preferred embodiment of the invention, two folding parts together forming the support bottom are attached to two opposite side walls.

Depending on the dimensions or dimensional ratios, however, it is also possible, if appropriate, to fasten the entire support bottom in the form of a single folding part to one of the side walls.

A further embodiment of the invention includes a foldable support bottom in the form of a single folding part attached to one side wall.

As a rule, the folding part or the folding parts will be formed of the same material as or similar material as the side walls and be connected via a prepared folding line to a material strip which extends roughly at the depth or level of the grooves and is fastened, preferably glued or welded, to the side wall.

This embodiment is especially simple and expedient. It uses the parts of the grooves for the fastening. The folding line is disposed precisely where it is needed so that the folding parts are laid closely onto the bearing surface of the bottom.

According to another feature of the invention, the side walls, when inserted in the grooves, extend into the molded-out hollows and are supported in the molded-out hollows.

According to yet another feature of the invention, the support bottom includes a further support bottom part fastened as a folding part to another one of the side walls such that the support bottom part and the further support bottom part are fastened to respective opposite ones of the side walls for forming the support bottom.

According to a further feature of the invention, the support bottom part is a foldable folding part fastened to one of the side walls for forming the support bottom.

According to another feature of the invention, the support bottom part and the side walls are formed of a substantially identical material.

According to a further feature of the invention, a material strip is fastened to one of the side walls, the material strip extending substantially on a same level as the grooves, when the side walls are inserted in the grooves; and the support bottom part being fastened as a folding part to the material strip via a given folding line.

According to another feature of the invention, the material strip is glued or welded to one of the side walls.

According to another feature of the invention, the side walls are configured to be folded together by bending in two opposite ones of the side walls; and the support bottom part is fastened to one of the side walls other than the two opposite ones of the side walls.

According to a further feature of the invention, the side walls are configured to be folded up by bending in a first one and a second one of the side walls, the first one and the second one of the side walls are opposite one another; the support bottom includes a further support bottom part; and the support bottom part and the further support bottom part are respectively fastened as folding parts to a third one and a fourth one of the side walls.

According to another feature of the invention, the plastic preform has supports selected from the group consisting of protruding shoulders and brackets, the supports are formed on the edge wall of the plastic preform; the plastic preform has corner regions, given ones of the molded-out hollows are disposed at the corner regions; the supports protruding at least into the given ones of the molded-out hollows at the corner regions of the plastic preform; and the supports being configured to support the side walls, when the side walls are inserted into the grooves.

According to yet another feature of the invention, the grooves have respective groove floors; at least one of the side walls has a straight lower edge; given ones of the supports and at least a given one of the groove floors are configured to support the straight lower edge; and the given ones of the supports have support surfaces disposed at a same level as the given one of the groove floors.

According to another feature of the invention, a lid is configured to be placed onto the side walls at a top region thereof such that the lid surrounds the side walls at the top region of the side walls, when the side walls are inserted in the grooves; and the plastic preform having an edge region peripheral to the grooves, the plastic preform has a seat formed in the edge region, the seat is configured to accept the lid, when the side walls are in a collapsed state.

According to another feature of the invention, the edge wall of the plastic preform has an inner side; and the seat is configured as a shoulder extending along the inner side of the edge wall of the plastic preform.

According to another feature of the invention, the shoulder is a continuous shoulder extending uninterrupted along the inner side of the edge wall of the plastic preform.

According to a further feature of the invention, the side walls have downwardly extending portions extending into given ones of the molded-out hollows and are supported in the molded-out hollows.

Other features which are considered as characteristic for the invention are set forth in the appended claims.

Although the invention is illustrated and described herein as embodied in a collapsible container, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
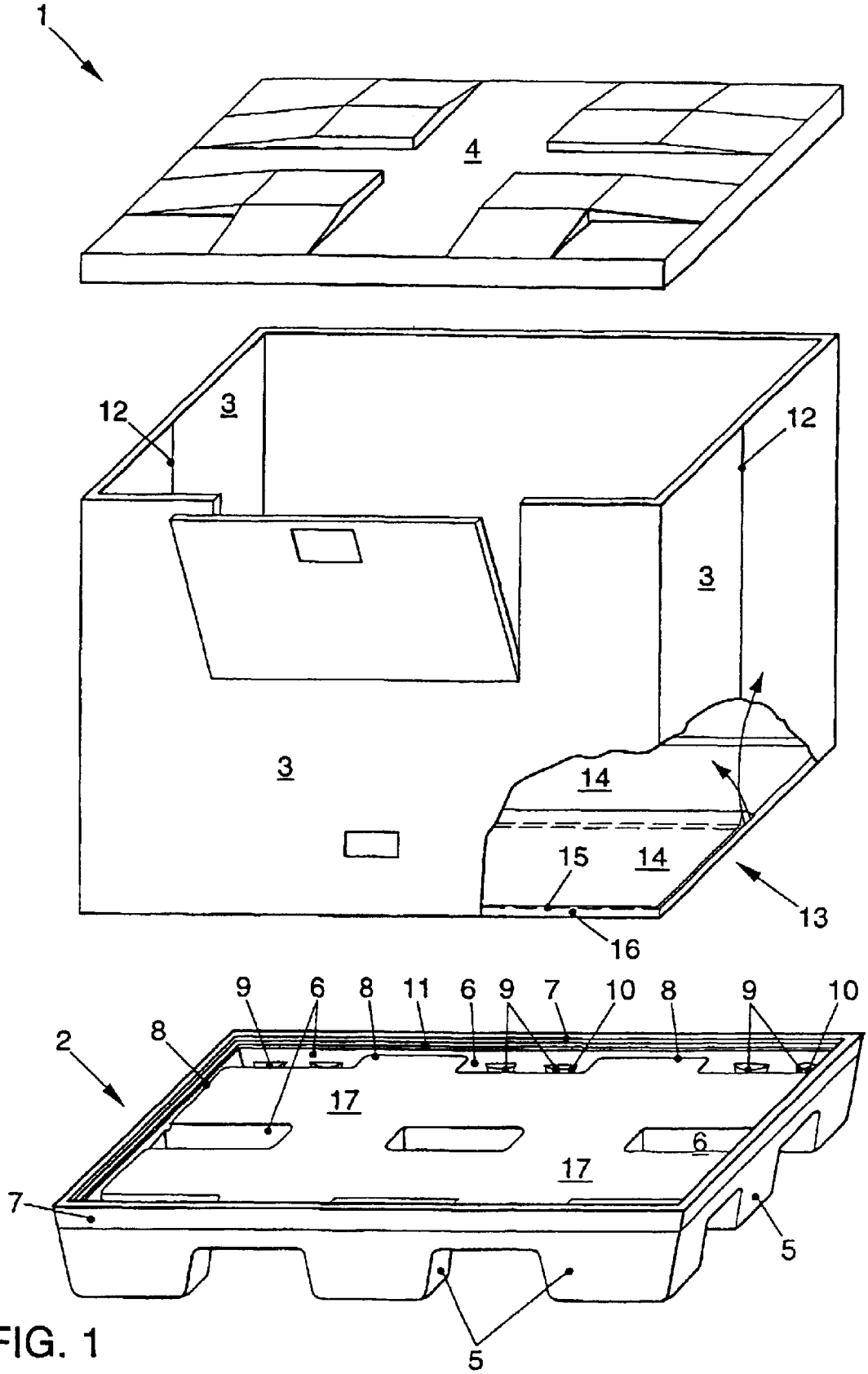
FIG. 1 is an isometric, exploded view of a collapsible container according to the invention.

Referring now to the figures of the drawings in detail and first, particularly, to FIG. 1 thereof, there is shown a container 1 formed of a bottom 2, four side walls 3 connected at the vertical edges made of strong corrugated board, hollow-chamber panels made of plastic or similar material, and a lid 4.

The bottom 2 is provided with feet 5 at the four corners and on the side centers and with a foot in its center. The feet 5 are in the form of hollows in the bottom 2, which are designated by 6. Between the hollows 6, grooves 8 extend on the edge wall or side walling 7 of the bottom 2.

On the edge wall 7, brackets 9 in the form of cone portions are formed in the region of the hollows 6. The support surfaces 10 of the brackets 9 lie at the same height as the floor of the grooves 8.

The side walls 3 are inserted into the grooves 7 and the hollows 6 of the bottom 2. In the grooves 7, they then lie on the groove floor and, in the hollows 6, they lie on the brackets 9.

The lid is formed such that it surrounds the side walls 3 at the top and such that a further container 1 can be placed on it with its bottom 2 such that the bottom 2 of the further container is secured against slipping.

The bottom 2 has a seat for the lid 4 in the form of a shoulder 11 at an edge region of the edge wall 7.

Figure 2:
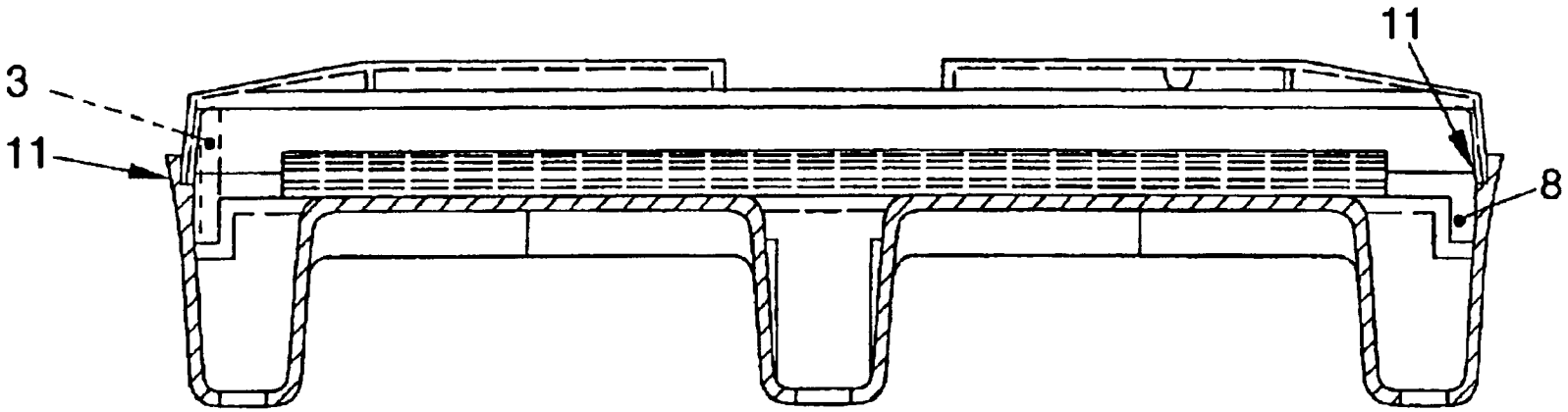
FIG. 2 is a vertical sectional view of the container according to the invention in a collapsed state.

As can be seen from FIG. 2, this seat lies outside the side walls 3 of the container, so that the lid 4, as illustrated in broken lines on the left in FIG. 2, can surround the side walls 3 at the top.

The side walls 3 of the container 1 can be folded up by virtue of the two smaller side walls 3 being bent at a folding line 12 provided in their center.

In the collapsed state according to FIG. 2, there is space for the folded-up side walls 3 between the bottom 2 and the lid 4. Attached to the two larger side walls 3 is a support bottom 13, made of the same material as the side walls, in the form of two folding parts 14 which each form half of the support bottom 13. They have an edge strip 16 which is separated from them by a prepared folding line 15. The edge strip 16 lies against the lower edge of the side wall 3 and is glued to the side wall 3 along the lower edge. The width of the edge strip 16 is roughly the same as the depth of the grooves 7, so that the folding line 15 lies at the height of the bearing surface 17 of the bottom 2 and the folding parts 14 come to lie flatly and on this surface so that there is contact between the folding parts and the surface 17. In the folded-up state, the folding parts 14 lie against the side walls 3.

We claim:

1. A collapsible container, comprising:

a plastic preform as a container bottom;

said plastic preform having downwardly molded-out hollows formed therein as feet for said container bottom, said feet being spaced apart from one another and defining a lifting fork engagement space therebetween;

said plastic preform having an edge wall, said plastic preform being formed with grooves extending along said edge wall, said grooves starting at a respective one of said hollows and ending at a respective next one of said hollows; side walls configured to be inserted into said grooves and configured to be supported in said grooves, said side walls, when inserted in said grooves, defining vertical container edges, said side walls being connected to one another at said vertical container edges and being foldable at said vertical container edges, said grooves being configured to support said sidewalls when inserted in said grooves;

a material strip fastened to one of said side walls, said material strip and said one of said side walls being separate from one another prior to said material strip being fastened to said one of said side walls, said material strip extending substantially on a same level as said grooves, when said side walls are inserted in said grooves; and a support bottom including a support bottom part fastened as a folding part to said material strip via a given folding line, said folding part resting on said plastic preform when said side walls are inserted in said grooves.

2. The container according to claim 1, wherein said side walls, when inserted in said grooves, extend into said molded-out hollows and are supported in said molded-out hollows.

3. The container according to claim 1, wherein said support bottom includes a further support bottom part fastened as a folding part to another one of said side walls such that said support bottom part and said further support bottom part are fastened to respective opposite ones of said side walls for forming said support bottom.

4. The container according to claim 1, wherein said support bottom part is a foldable folding pare fastened to one of said side walls for forming said support bottom.

5. The container according to claim 1, wherein said support bottom part and said side walls are formed of a substantially identical material.

6. The container according to claim 1, wherein said material strip is glued to one of said side walls.

7. The container according to claim 1, wherein said material strip is welded to one of said side walls.

8. The container according to claim 1, wherein:

said side walls are configured to be folded together by bending in two opposite ones of said side walls; and said support bottom part is fastened to one of said side walls other than said two opposite ones of said side walls.

9. The container according to claim 1, wherein:

said side walls are configured to be folded up by bending in a first one and a second one of said side walls, said first one and said second one of said side walls are opposite one another;

said support bottom includes a further support bottom part; and said support bottom part and said further support bottom part are respectively fastened as folding parts to a third one and a fourth one of said side walls.

10. The container according to claim 1, where in:

said plastic preform has supports selected from the group consisting of protruding shoulders and brackets, said supports are formed on said edge wall of said plastic preform;

said plastic preform has corner regions, given ones of said molded-out hollows are disposed at said corner regions;

said supports protruding at least into said given ones of said molded-out hollows at said corner regions of said plastic preform; and said supports being configured to supports said side walls, when said side walls are inserted into said grooves.

11. The container according to claim 10, wherein:

said grooves have respective groove floors;

at least one of said side walls has a straight lower edge;

given ones of said supports and at least a given one of said groove floors are configured to support said straight lower edge; and said given ones of said supports have support surfaces disposed at a same level as said given one of said groove floors.

12. The container according to claim 1, including;

a lid configured to be placed Onto said side walls at a top region thereof such that said lid surrounds said side walls at said top region of said side walls, when said side walls are inserted in said grooves; and said plastic preform having an edge region peripheral to said grooves, said plastic preform having a seat: formed in said edge region, said seat being configured to accept said lid, when said side walls are in a collapsed state.

13. The container according to claim 12, wherein:

said edge wall of said plastic preform has an inner side; and said seat is configured as a shoulder extending along said inner side of said edge wall of said plastic preform.

14. The container according to claim 13, wherein said shoulder is a continuous shoulder extending uninterrupted along said inner side of said edge wall of said plastic preform.

15. The container according to claim 1, wherein said side walls have downwardly extending portions extending into given ones of said molded-out hollows and are supported in said molded-out hollows.

* * * * *